US007029023B2

(12) United States Patent
Fougere

(10) Patent No.: US 7,029,023 B2
(45) Date of Patent: Apr. 18, 2006

(54) SNOWBOARD BINDING WITH TENSIONING MEMBER FOR DETERMINING NEUTRAL POSITION

(76) Inventor: Raymond D. Fougere, 222 Riverside Dr., Tiverton, RI (US) 07878

( * ) Notice: Subject to any disclaimer, the term of this patent is extended or adjusted under 35 U.S.C. 154(b) by 0 days.

(21) Appl. No.: 10/483,640

(22) PCT Filed: Jul. 17, 2002

(86) PCT No.: PCT/US02/22566

§ 371 (c)(1),
(2), (4) Date: Jan. 13, 2004

(87) PCT Pub. No.: WO03/008049

PCT Pub. Date: Jan. 30, 2003

(65) Prior Publication Data

US 2004/0169343 A1 Sep. 2, 2004

Related U.S. Application Data

(60) Provisional application No. 60/306,128, filed on Jul. 17, 2001.

(51) Int. Cl.
*A63C 9/08* (2006.01)

(52) U.S. Cl. ..... 280/611; 280/14.22; 280/11.36; 280/631; 280/633; 280/626; 280/623

(58) Field of Classification Search ..... 280/14.22, 280/11.36, 611, 631, 633, 626, 623
See application file for complete search history.

(56) References Cited

U.S. PATENT DOCUMENTS 3,870,325 A * 3/1975 Davis ..... 280/611

(Continued)

*Primary Examiner*—Lesley D. Morris
*Assistant Examiner*—Marlon Arce-Diaz
(74) *Attorney, Agent, or Firm*—Marina Larson & Associates, LLC

(57) ABSTRACT

A snowboard binding is provided having a base to accommodate the boot of the user and keep it in a fixed position on the base; and a highback. The highback is adapted to allow the leg of a user to articulate through a range of motion. Attached to the highback is a system of springs or elastic members for returning the leg of the user to a neutral position relative to the board in the absence of an applied counterforce. For example, the highback can be attached to the base in such a manner as to allow the highback to articulate in a range extending from a forward position to a neutral position, and optionally to a rearward position, the neutral position being disposed between the forward position and any rearward position. In this binding, a tensioning member is affixed to the highback in such a manner as to resist articulation of the highback to the forward or the rearward position, and to apply a force to the highback to return it to the neutral position in the absence of an applied counterforce. Alternatively, the highback can be affixed to the base so that it does not articulate in use, so that the position of the highback is fixed relative to the base. In this case, the articulation of the user's leg results in movement of the leg away from the highback. Straps having an elastic portion and a rigid portion of defined length are attached to the highback and to the base to hold the foot in place. In the absence of an applied counterforce, for example when the user is airborne, the elastic straps draw the user legs back into a neutral position against the base and highback.

4 Claims, 10 Drawing Sheets

U.S. PATENT DOCUMENTS 4,367,885 A * 1/1983 Ramer ..... 280/614
4,703,946 A * 11/1987 Nava ..... 280/627
4,964,649 A 10/1990 Chamberlin
5,020,823 A * 6/1991 Bogner ..... 280/634
5,028,068 A 7/1991 Donovan
5,276,982 A * 1/1994 Wittmann ..... 36/118.4
5,435,080 A 7/1995 Meiselman
5,813,689 A 9/1998 Mansure
5,971,407 A 10/1999 Zemke et al.
6,032,974 A * 3/2000 Saillet ..... 280/611
6,283,492 B1 * 9/2001 Hale ..... 280/611
6,450,525 B1 9/2002 Reuss et al.
6,736,413 B1 * 5/2004 Laughlin et al. ..... 280/14.22

* cited by examiner

SNOWBOARD BINDING WITH TENSIONING MEMBER FOR DETERMINING NEUTRAL POSITION

This application is a Section 371 National Phase of PCT/US02/22566 and claims the benefit of U.S. Provisional Application Ser. No. 60/306,128, filed Jul. 17, 2001, which application is incorporated herein by reference.

BACKGROUND OF THE INVENTION

The present invention relates to a snowboard binding which is particularly effective for use in new, extreme practices where the athlete wants to execute jumps and acrobatic figures. Such uses require a substantial articulation of the ankle joints and increases the loading on these joints.

FIG. 1 shows a snowboard binding of a type known in the art. There is a rigid highback (2), a rigid base (1), with lateral heel supports (11, 11'). The highback (2) is attached to base (1) at a transverse axis passing through points (5, 5') and secured with rivets or some other fastening device. Straps (3, 3') secure the foot to the binding. An optional strap (4) is attached to the highback and also wraps around the lower leg of the user. The highback (2) is generally fixed in position with respect to the base (1) about the transverse axis and the lower leg of the user moves forward relative to the highback as a result of bending of the knees. For more extreme practices, however, this binding is insufficient because it provides inadequate support for the ankle and lower leg of the user. Furthermore, while it is desirable to land on the toe edge of the snowboard following most aerial maneuvers, it may be difficult to alter the position of the board without significant weight shifts (which can loss of balance and a fall), because the air provides no resistance against which to act in moving the position of the board.

Thus, the problem consists of providing a sports boot/binding that allows flexibility and gives a means to control the position of the snowboard, even while airborne, and to support the ankle/lower leg that still maintains flexibility of the ankle joints.

SUMMARY OF THE INVENTION

The present invention provides an improved snowboard binding comprising a base to accommodate the boot of the user and keep it in a fixed position on the base; and a highback. The highback is adapted to allow the leg of a user to articulate through a range of motion. Attached to the highback is a means for returning the leg of the user to a neutral position relative to the board in the absence of an applied counterforce. In one embodiment of the invention, the highback is attached to the base in such a manner as to allow the highback to articulate in a range extending from a forward position to a neutral position, and optionally on to a rearward position, the neutral position being disposed between the forward position and any rearward position. In this embodiment, a tensioning member is affixed to the highback in such a manner as to resist articulation of the highback to the forward or the rearward position, and to apply a force to the highback to return it to the neutral position in the absence of an applied counterforce.

In an alternative embodiment, the highback is affixed to the base of the binding at least at two points on each side, or the highback and base are formed form a single piece, so that the position of the highback is fixed relative to the base. In this case, the articulation of the user's leg results in movement of the leg away from the highback. Straps having an elastic portion and a rigid portion of defined length are attached to the highback and to the base to hold the foot in place. In the absence of an applied counterforce, for example when the user is airborne, the elastic straps draw the user's leg back into a neutral position against the base and highback.

BRIEF DESCRIPTION OF THE DRAWINGS

The invention will be better understood and other characteristics thereof will become more apparent with the help of the following description, with reference to the annexed schematic drawings, which represent, as nonrestrictive examples, several preferred embodiments wherein.

DETAILED DESCRIPTION OF THE INVENTION

The present invention provides a snowboard binding having the same basic components as known snowboard bindings, including in particular a base and a highback. The highback is adapted to allow the leg of a user to articulate through a range of motion. Attached to the highback is a means for returning the leg of the user to a neutral position relative to the board in the absence of an applied counterforce. A variety of constructions can be used to provide this function as will be described below.

In one embodiment of the snowboard binding of the invention, the highback is attached to the base in such a manner that it can articulate during use. A tensioning member is provided which is affixed to the highback in such a manner as to resist articulation of the highback to the forward or any rearward position, and to apply a force to the highback to return it to the neutral position in the absence of an applied counterforce, for example one applied by the leg of the user. Such a construction provides support to the ankle upon flexion and at the same time enables it to retain a permanent reference (the neutral position), in other words, an elastic return memory, such reference playing an important role in the retention of the ankle, by the using the proprioceptive qualities of the lower leg of the user. The requirements of mobility and support are thus met.

A variety of constructions can be designed for the binding, and as such the desired reference position of the highback can be obtained. In one such embodiment by incorporating a tensioning member such as a torsion spring, torsion bar or other suitable devise in the vicinity of or about the journal axis, a reference or neutral position can be established. In another embodiment, a tension/compression spring can be connected directly to the highback and the binding base. In any of the aforementioned configurations, a device can be added to limit the rearward motion of the highback and still allow forward motion while retaining the reference or neutral position.

Figure 1:
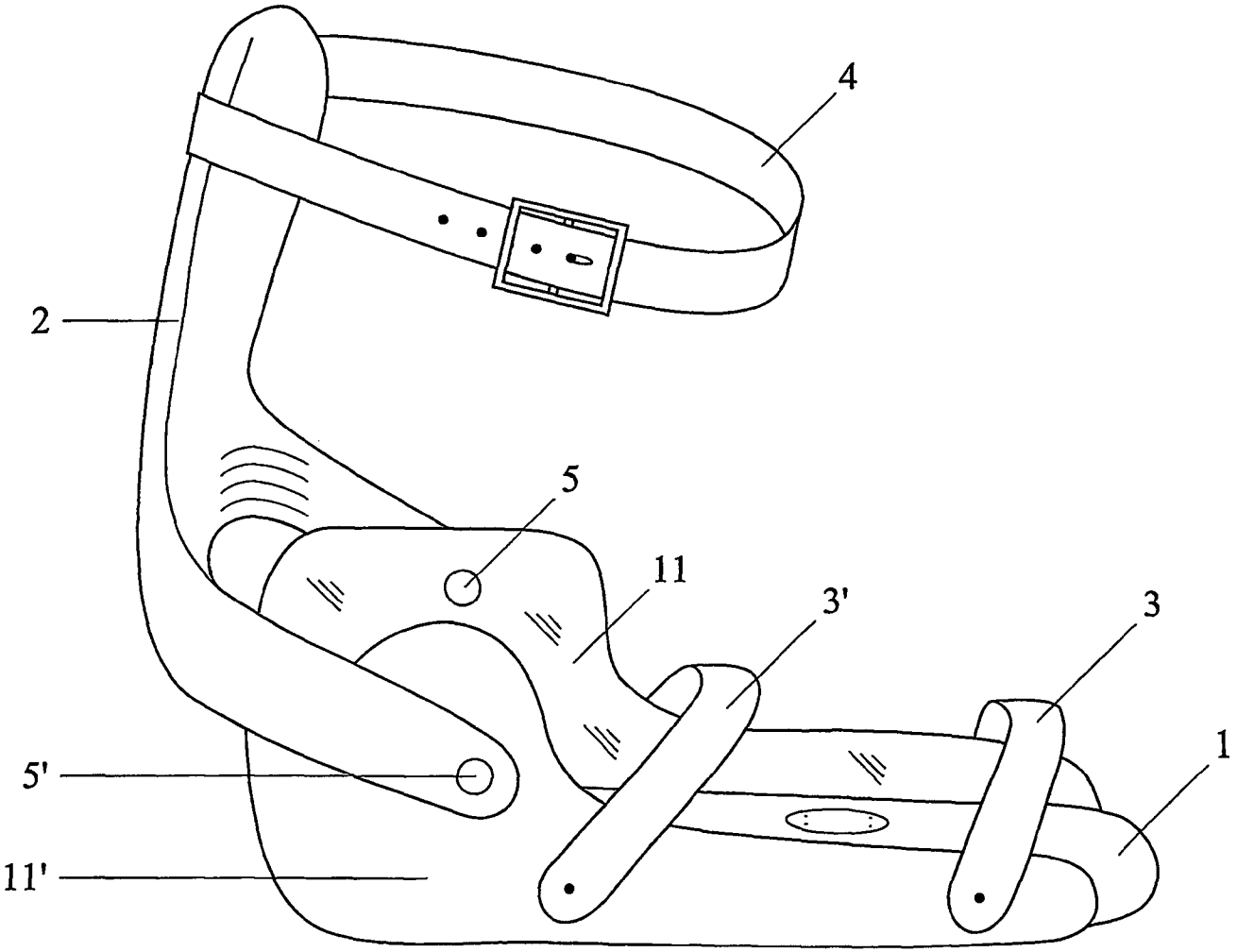
FIG. 1 shows a snowboard binding according to the prior art.
Figure 2:
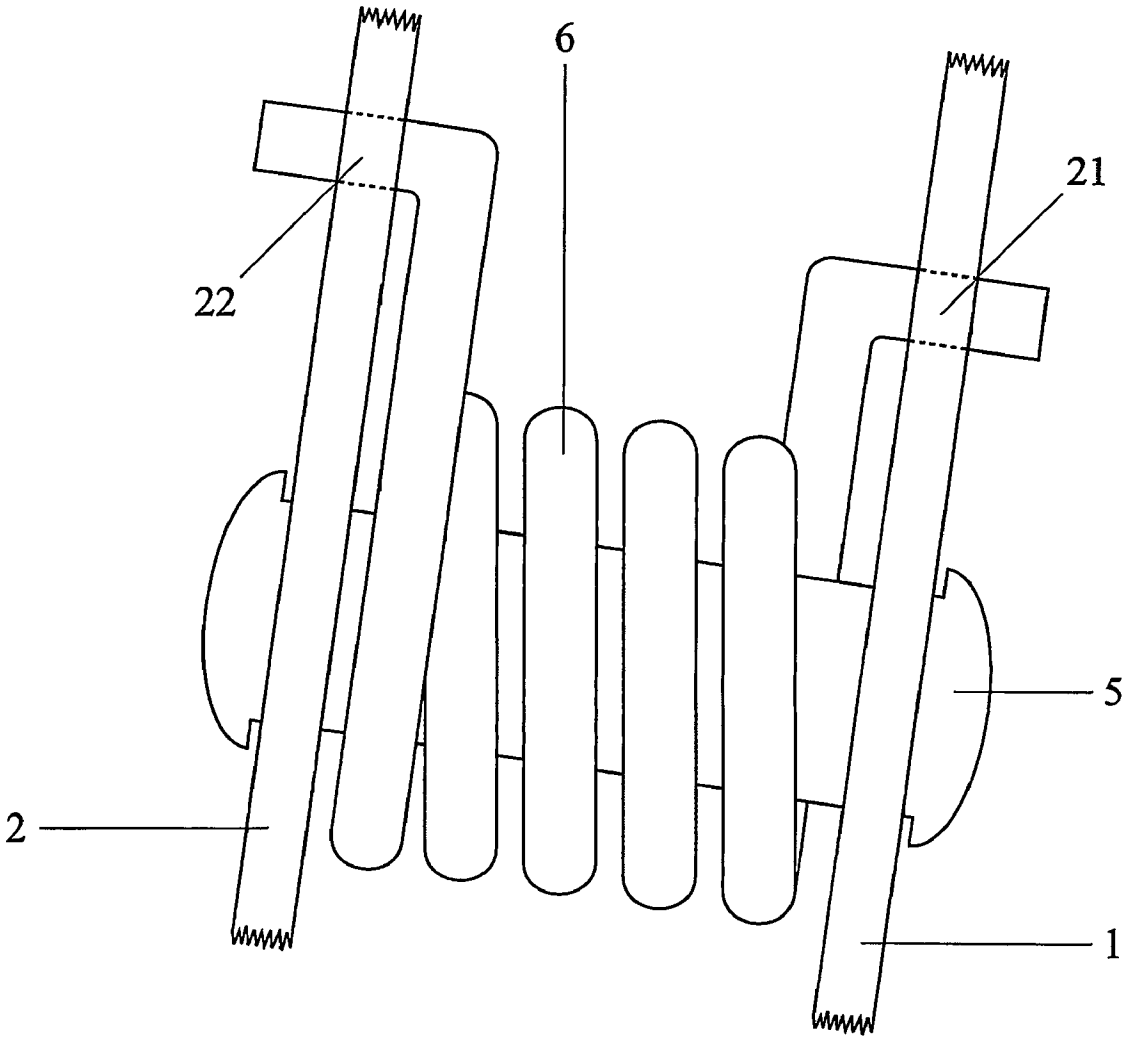
FIG. 2 shows a transverse view of the transverse journal area showing the position of a torsion spring with the highback in the neutral (reference) position.

FIG. 2 shows a tensioning member in accordance with a first embodiment of the invention. The tensioning member is a spring (6) disposed around journal (5). One end of the spring (6) is connected to the base (1) and the other end to the highback (2), for example by passing the ends of the spring (6) through holes (21, 22) in the base (1) and highback (2). The spring (6) acts to restore the highback to a neutral position relative to the base which is defined by the relative connection points of the spring (6) to the base (1) and highback (2). To provide the user with a selection of different neutral positions, a plurality of holes can be provided in the base (1), the highback (2) or both.

Figure 3A:
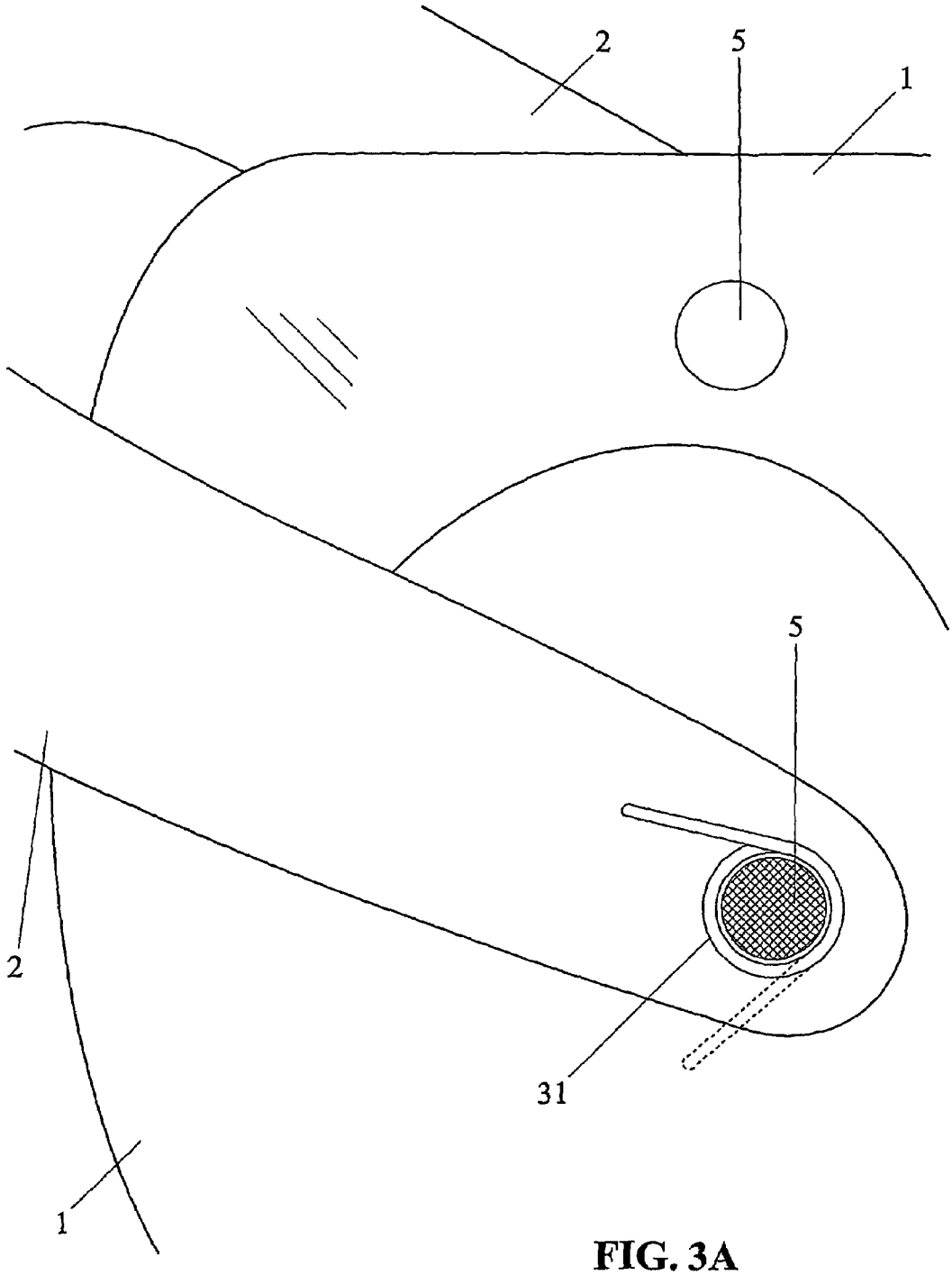
FIG. 3*a* shows the torsion spring at the journal about the transverse axis.

FIG. 3*a* shows a close up side view of the transverse axis area in a further embodiment of the invention. In this case, a journal (5) is fitted between the base (1) and highback (2) with torsion spring (31) shown holding the highback in the neutral position. The embodiment of FIG. 3*a* differs from that of FIG. 2. in that the torsion spring (31) is positioned on the exterior of the highback (2), rather than between the highback (2) and the base (1). It can be seen that the highback can move either forward or backward from this neutral position and the spring will restore the highback to its original (neutral) position. Additional holes for receiving the ends of torsion spring (31) could be included as described above.

Figure 3B:
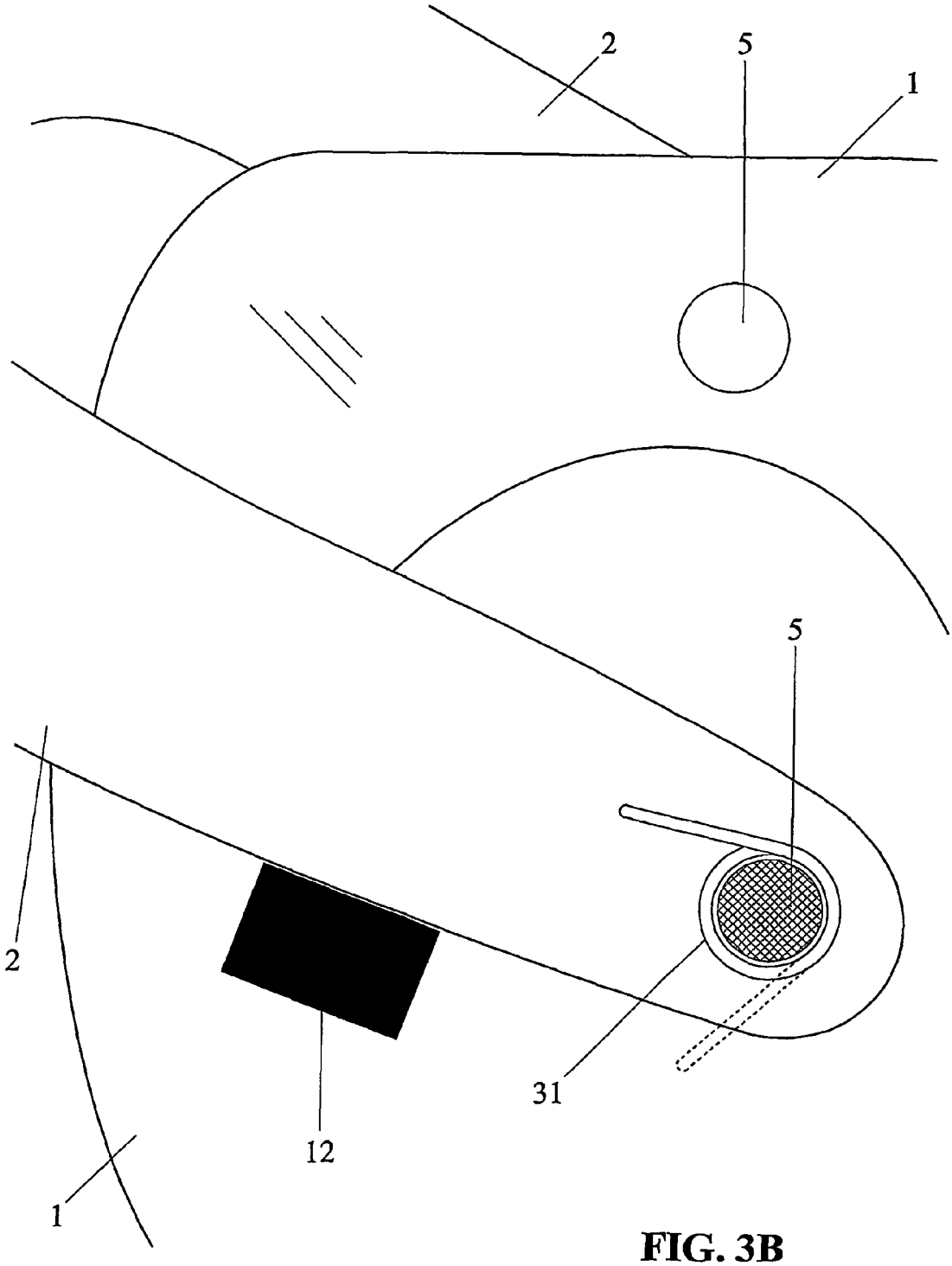
FIG. 3*b* shows a view similar to FIG. 3*a* except a stop has been placed in such a position as to prevent rearward rotation of the highback.

FIG. 3*b* is similar to FIG. 3*a* except there is a stop (12) placed on the base (1) to prevent rearward travel of the highback (2) past a predetermined point. The position of the stop (12) may be adjustable or it may be fixed.

Figure 4A:
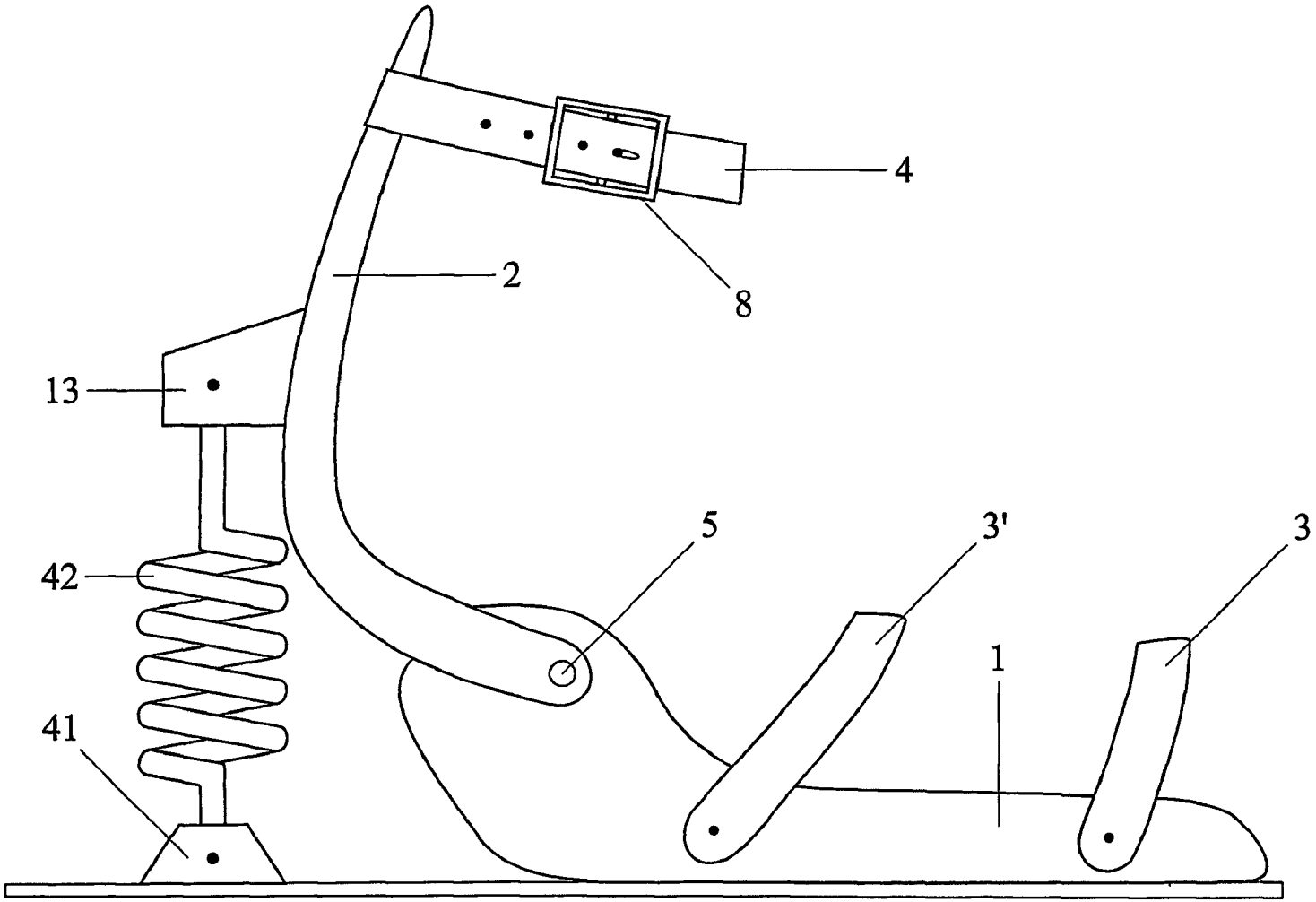
FIGS. 4*a–d* show snowboard bindings in accordance with the invention.

FIG. 4*a* is a side view of the snowboard binding showing a base (1) with a rear extension (1') and a mounting structure (41) for a spring (42), a highback (2) with a mount (13) for the spring (42), highback strap (4) with a method for changing the length at buckle (8), straps (3) and (3') for holding the foot in place. The spring (42) holds the highback in a neutral position unless it is moved by a counterforce. It can be seen from FIG. 4*a* that when the lower leg is moved forward resistance builds to help support the leg as in the reaction to an aerial landing when the knees bend naturally in reaction to the landing. A compression spring (not shown) could be installed coaxially with spring (42) for the purpose of giving greater resistance when the highback is rotated rearward, although spring 42 itself can provide resistance in both direction. The compression spring could also be include at some position other than coaxial, for example parallel to the expansion spring. Two compression springs or two expansion springs working in opposition might also be employed. In an alternative to the structure shown in FIG. 4*a*, the mount 41 can be attached to the snowboard (45) directly rather than to a part of the binding (FIG. 4*d*).

Figure 4B:
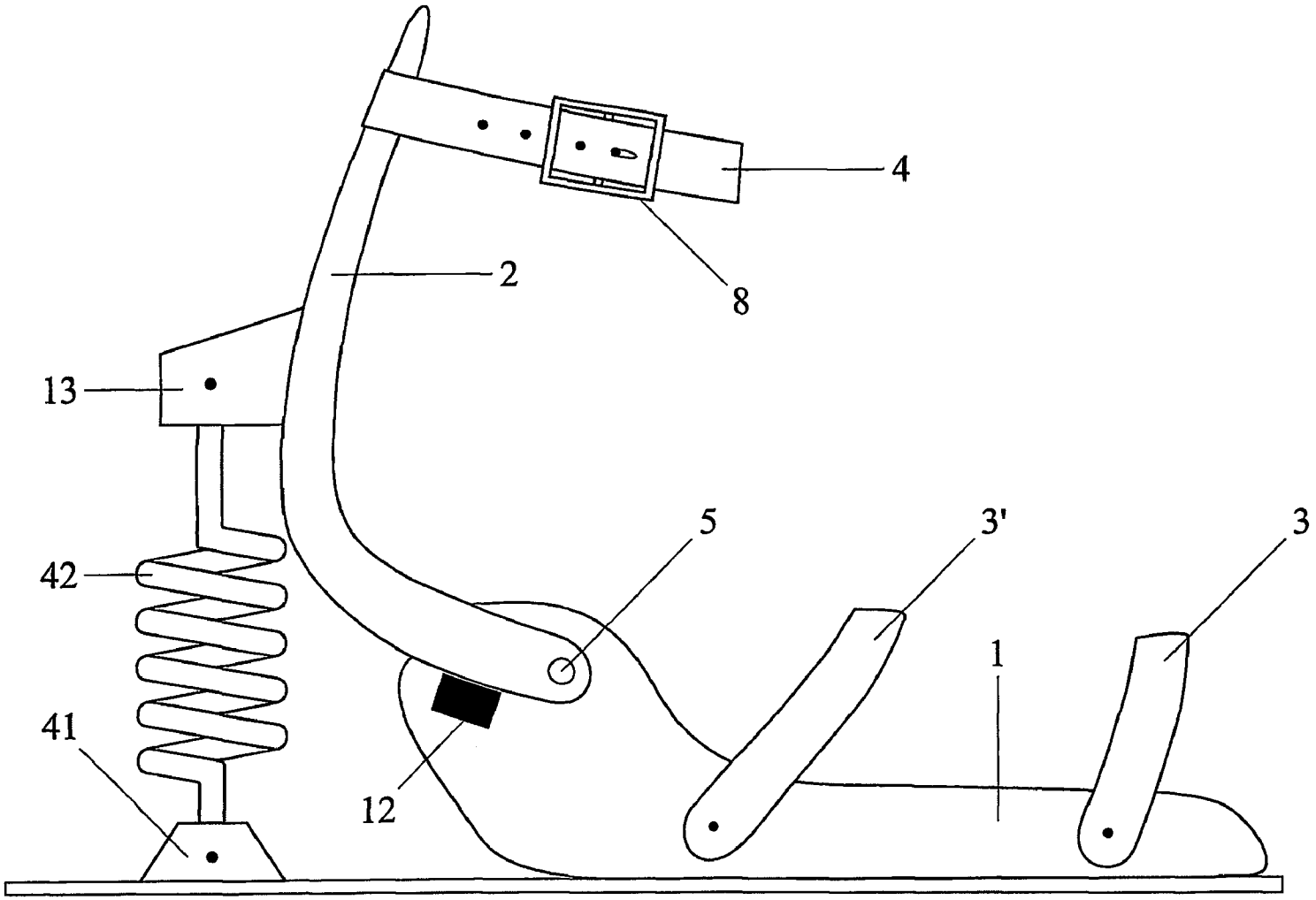

FIG. 4*b* is similar to FIG. 4*a* except a stop (12) is placed on base 1 in such a manner that the highback (2) just rests on it in the neutral position thus preventing rearward motion of the highback past that point. In this an other embodiments, stop (12) can be of composed of a solid material and be a "dead" stop, or it can be made of rubber or other elastic material to mitigate shock when the highback is propelled backward at a high velocity. The stop may be fixed or adjustable to change the neutral position of the highback.

Figure 4C:
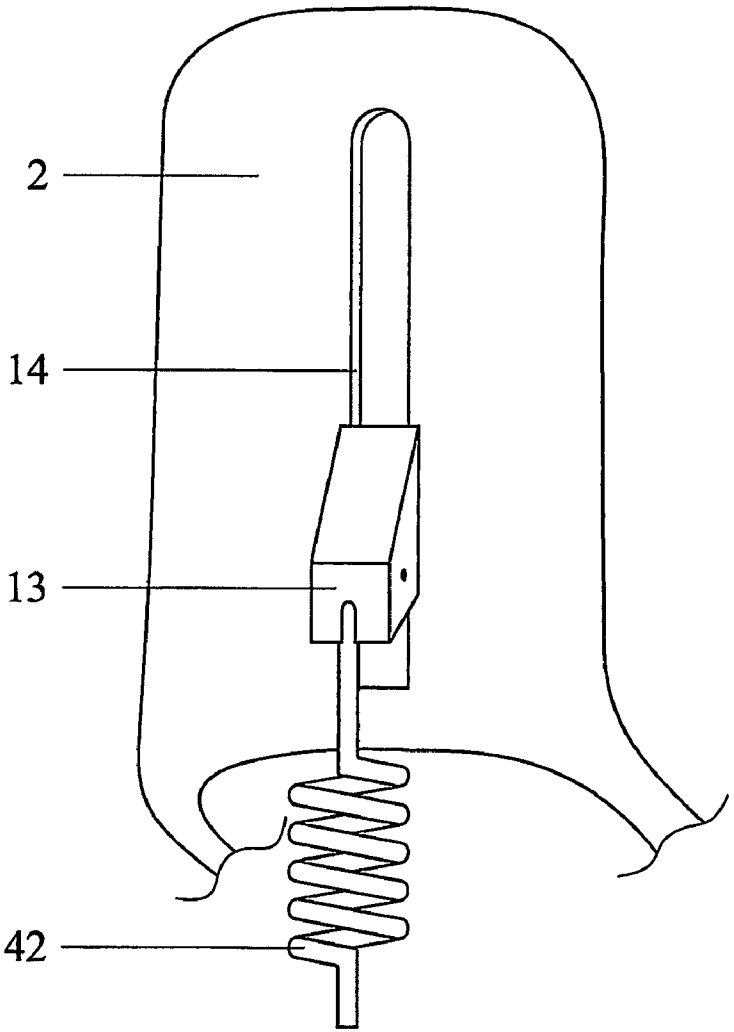
Figure 4D:
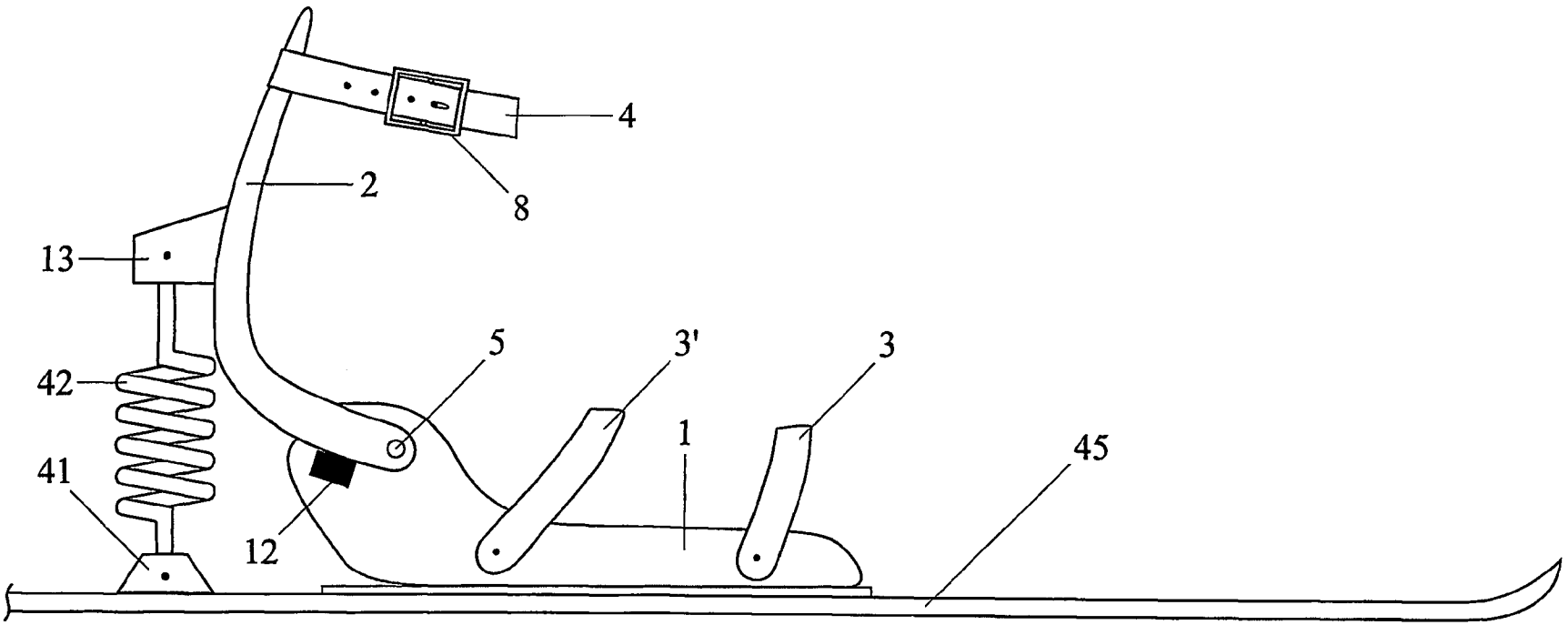

FIG. 4*c* shows rear of highback (2), and the mount (13) in greater detail. The mount (13) can move up and down in slider track (14). The mount (13) can be fixed in any position along the track (14) for the purpose of changing the neutral position of highback, for example with a set screw.

Figure 5A:
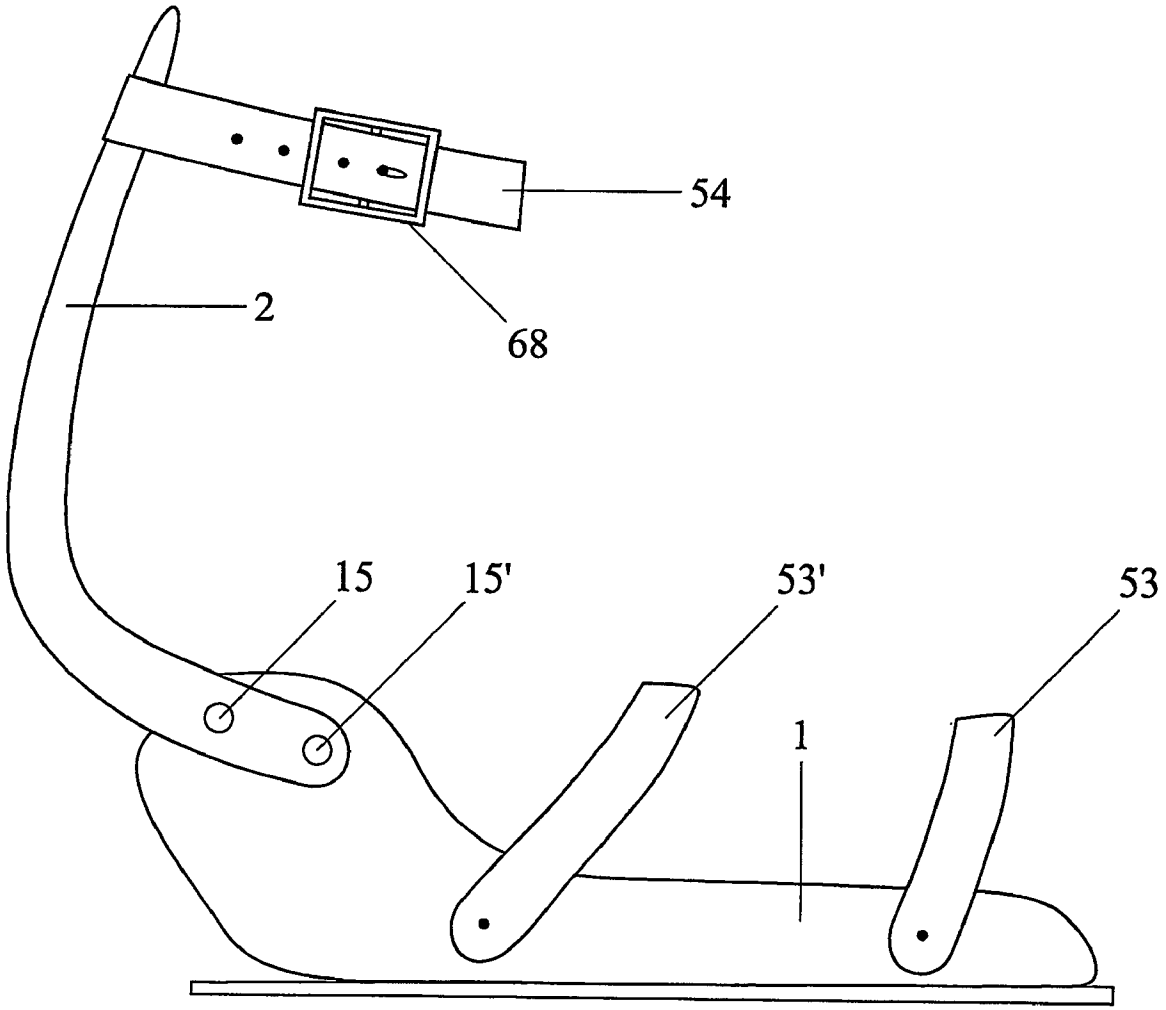
FIG. 5*a* shows a view of the base and highback showing a fixed highback and an elastic strap, with an adjusting buckle, attached to the highback.
Figure 5B:
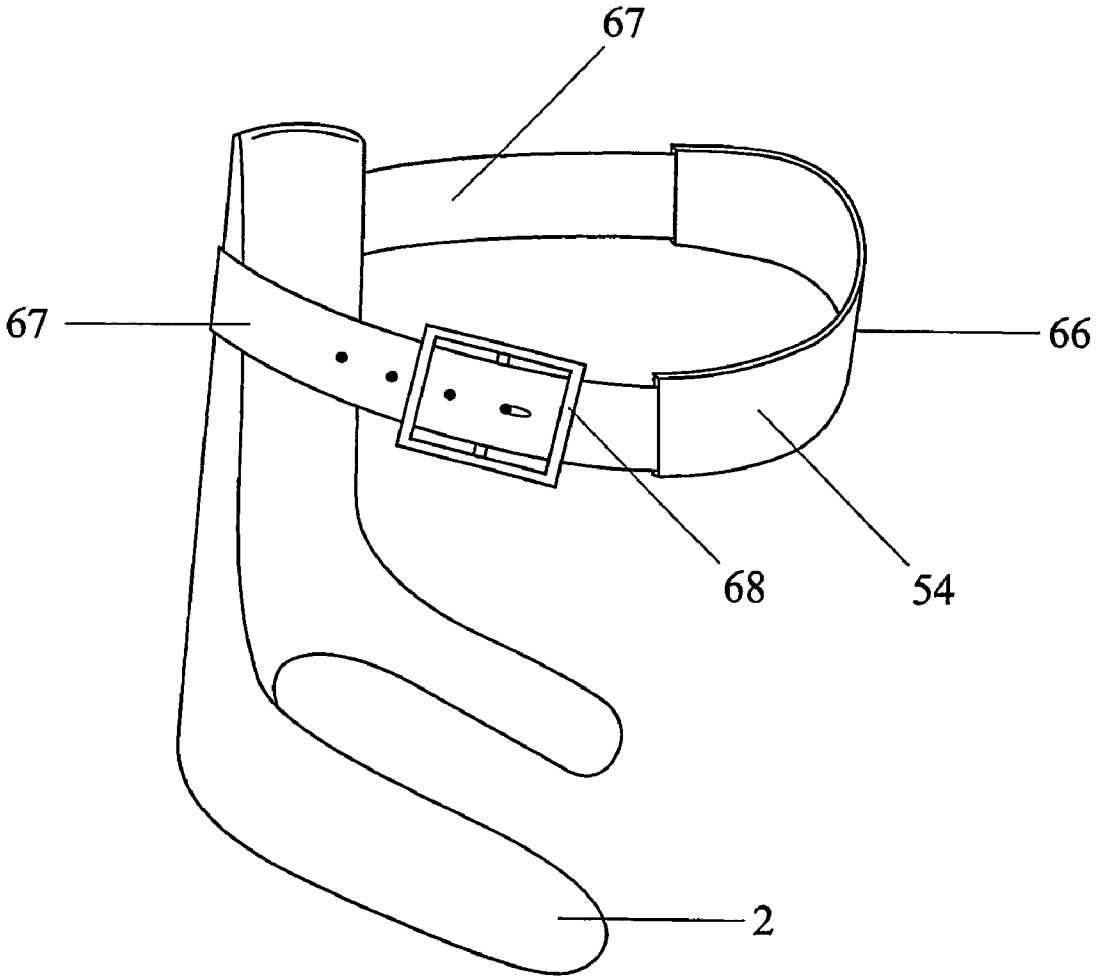
FIG. 5*b* shows a view of the highback with a strap having an elastic section, a rigid section and an adjusting means.

As an alternative to an articulating highback, the highback may be held in a fixed position relative to the base when the binding is in use, either as a result of fixation at multiple points or as a result of a locking mechanism to hold it in place (such a locking mechanism may allow articulation of a highback to a folded position for transport and storage). In this case, the articulation is achieved by movement of the user relative to the highback and base, and the straps holding the user into the binding are partially constructed of an elastic material which will pull the user's boot and leg back into a neutral position in contact with the binding in the absence of an applied counterforce. For example, FIG. 5*a* shows a view of a snowboard binding showing the rigid highback (2) a rigid base (1) with lateral heel supports said highback attached to the base in the area of the lateral heel supports with two or more fasteners (15, 15') to make the highback rigid with the base. Straps (53) and (53') secure the foot to the binding. A strap (54) is attached to the highback (2) and also wraps around the lower leg of the user. The straps (53, 53'and 54) comprise an elastic portion, a rigid portion, and a way of keeping the rigid portion at a fixed length. FIG. 5*b* is a view of a portion of the highback (2) and strap (54) showing an elastic portion (66) and a rigid portion (67) and the means for changing the length of the rigid section with a buckle etc. (68). The mechanism to change the length of the rigid portion may be mounted on the highback.

Some or all of the elastic straps of the type shown in FIGS. 5*a* and 5*b* may also be used in combination with the articulating highback, and this represents a further embodiment of the invention. In this case, the elastic straps increase the range of motion which can be provided to the user, and provides two co-acting mechanisms for return of the snowboard to a neutral position relative to the user's leg.

What is claimed is:

1. A snowboard binding comprising (a) a base to accommodate the boot of the user and keep it in a fixed position on the base;

(b) a highback attached to the base on inner and outer sides thereof, wherein the high back allows the leg of a user to articulate through a range of motion parallel to a line between the heel and tow of a boot fixed in the base; and (c) means for returning the leg of the user to a neutral position relative to the snowboard in the absence of an applied counterforce, wherein the means for returning the leg of the user to a neutral position comprises a plurality of straps, each having an elastic portion and a rigid portion, a first one of the plurality of straps being attached to the highback to hold the user's leg, and a second one of the plurality of straps being attached to the base to hold the user's foot.

2. The binding of claim 1, wherein the highback is fixed in position relative to the base when the binding is in use.

3. A snowboard having affixed thereto a binding wherein the snowboard binding comprises:

(a) a base to accommodate the boot of the user and keep it in a fixed position on the base;

(b) a highback attached to the base on inner and outer sides thereof, wherein the highback allows the leg of a user to articulate through a range of motion parallel to a line between the heel and tow of a boot fixed in the base; and (c) means for returning the leg of the user to a neutral position relative to the snowboard in the absence of an applied counterforce, wherein the means for returning the leg of the user to a neutral position comprises a plurality of straps, each having an elastic portion and a rigid portion, a first one of the plurality of straps being attached to the highback to hold the user's leg, and a second one of the plurality of straps being attached to the base to hold the user's foot.

4. The snowboard of claim 3, wherein the highback is fixed in position relative to the base when the binding is in use.

* * * * *